US009811996B1

(12) United States Patent
Eke

(10) Patent No.: US 9,811,996 B1
(45) Date of Patent: Nov. 7, 2017

(54) MISPLACED KEY-LOCATING SYSTEM

(71) Applicant: Agbai E. Eke, Dallas, TX (US)

(72) Inventor: Agbai E. Eke, Dallas, TX (US)

( * ) Notice: Subject to any disclaimer, the term of this patent is extended or adjusted under 35 U.S.C. 154(b) by 45 days.

(21) Appl. No.: 15/090,704

(22) Filed: Apr. 5, 2016

(51) Int. Cl.
*G08B 21/24* (2006.01)
*G08B 21/00* (2006.01)

(52) U.S. Cl.
CPC ..... *G08B 21/24* (2013.01)

(58) Field of Classification Search
CPC G08B 25/012; G08B 25/016; G08B 13/1409; G08B 13/1418; G08B 17/00; G08B 21/0208; G08B 21/0227; G08B 21/12; G08B 25/006; G08B 25/009; G08B 3/10; G08B 6/00; G08B 13/1436; G08B 21/0216
USPC ..... 340/8.1
See application file for complete search history.

(56) References Cited

U.S. PATENT DOCUMENTS

D452,221 S 12/2001 Garza
6,366,202 B1 * 4/2002 Rosenthal ..... G08B 21/0222 340/539.32
6,850,158 B1 2/2005 Williams
8,254,958 B2 8/2012 Johnson
2002/0126010 A1 9/2002 Trimble
2005/0168338 A1 8/2005 Parker
2006/0038676 A1 * 2/2006 Richards ..... G08B 21/0227 340/539.23
2012/0092160 A1 4/2012 Antonucci
2012/0172095 A1 7/2012 McDaniel

FOREIGN PATENT DOCUMENTS

WO 2007019423 2/2007

* cited by examiner

*Primary Examiner* — Yong Hang Jiang

(57) ABSTRACT

The misplaced key-locating system is a bidirectional location system that is adapted for use with a plurality of domestic articles. The misplaced key-locating system comprises a plurality of devices. Each of the plurality of devices is attached to a domestic article selected from the plurality of domestic articles. Each of the plurality of domestic devices is bidirectional in the sense that each device selected from the plurality of devices wirelessly communicates with the each of the devices remaining in the plurality of selected devices. This bidirectional capability allows any first device selected from the plurality of devices to initiate an announcement from any second device selected from the remaining devices in the plurality of devices. The announcement comprises audio and visual signals indicating the location of the selected second device.

6 Claims, 4 Drawing Sheets

MISPLACED KEY-LOCATING SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of signaling and calling systems, more specifically, a sound and light producing system of bidirectional devices.

SUMMARY OF INVENTION

The misplaced key-locating system is a bidirectional location system that is adapted for use with a plurality of domestic articles. The misplaced key-locating system comprises a plurality of devices. Each of the plurality of devices is attached to a domestic article selected from the plurality of domestic articles. Each of the plurality of domestic devices is bidirectional in the sense that each device selected from the plurality of devices wirelessly communicates with the each of the devices remaining in the plurality of selected devices. This bidirectional capability allows any first device selected from the plurality of devices to initiate an announcement from any second device selected from the remaining devices in the plurality of devices. The announcement comprises audio and visual signals indicating the location of the selected second device.

These together with additional objects, features and advantages of the misplaced key-locating system will be readily apparent to those of ordinary skill in the art upon reading the following detailed description of the presently preferred, but nonetheless illustrative, embodiments when taken in conjunction with the accompanying drawings.

In this respect, before explaining the current embodiments of the misplaced key-locating system in detail, it is to be understood that the misplaced key-locating system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the misplaced key-locating system.

It is therefore important that the claims be regarded as including such equivalent construction insofar as they do not depart from the spirit and scope of the misplaced key-locating system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
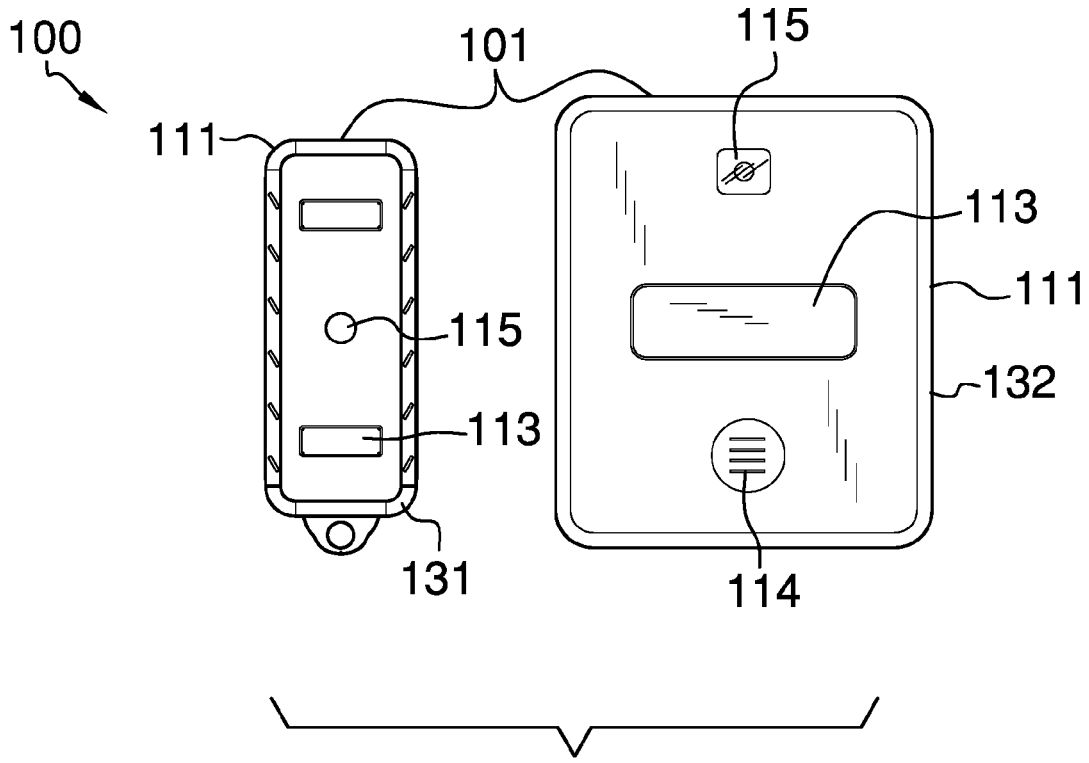
FIG. 1 is a top view of an embodiment of the disclosure.
Figure 2:
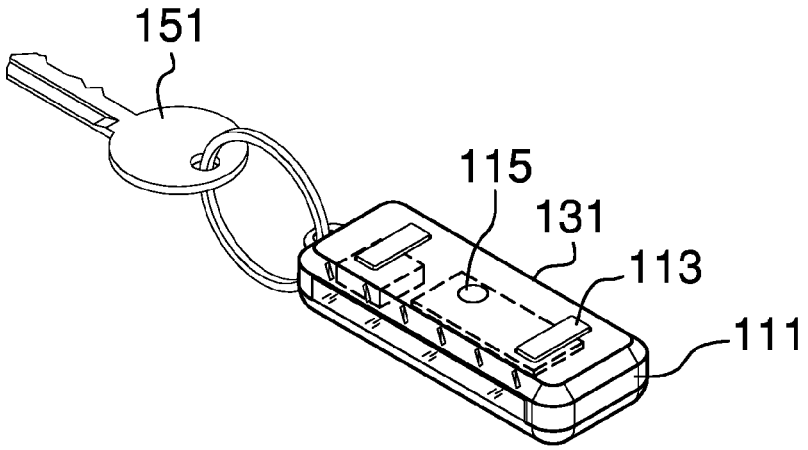
FIG. 2 is a perspective detail view of an embodiment of the disclosure.
Figure 3:
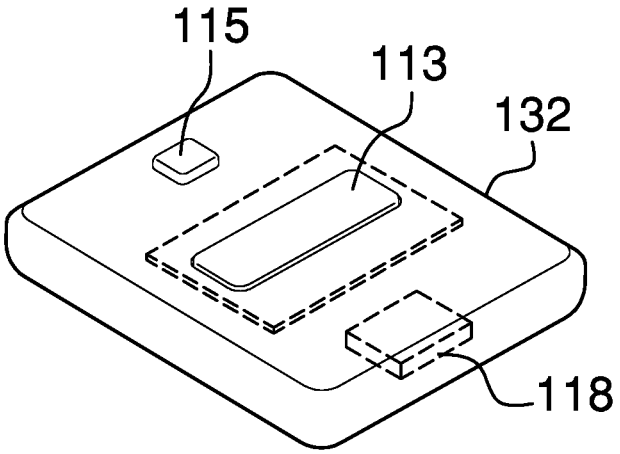
FIG. 3 is a perspective detail view of an embodiment of the disclosure.
Figure 4:
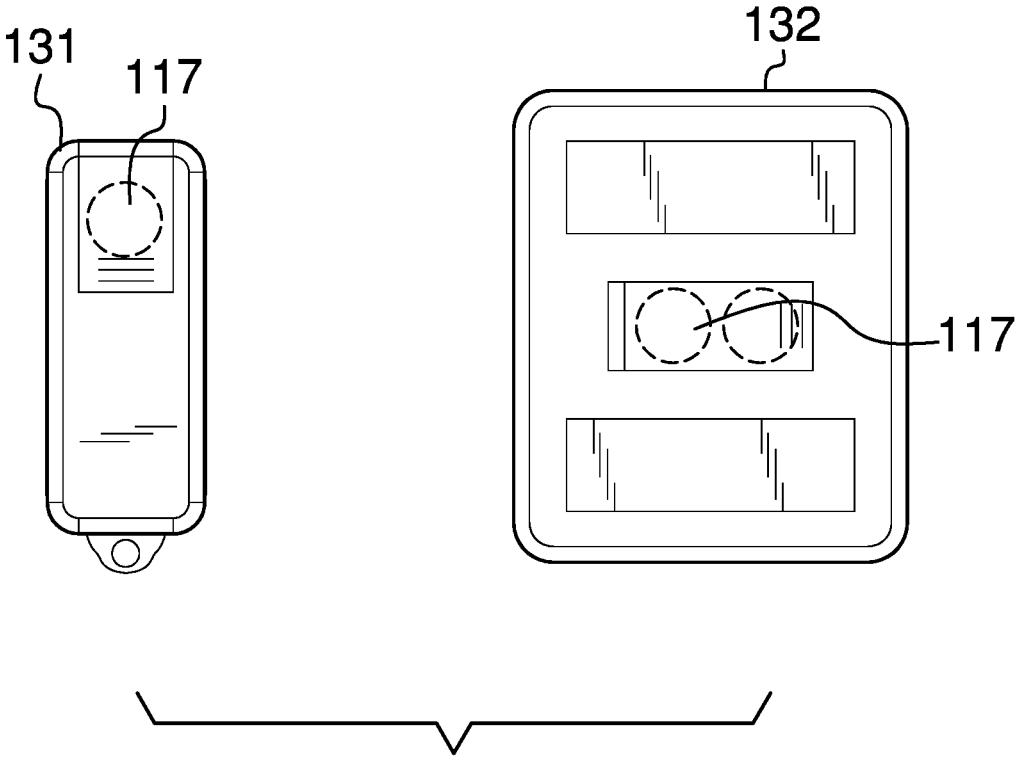
FIG. 4 is a bottom view of an embodiment of the disclosure.
Figure 5:
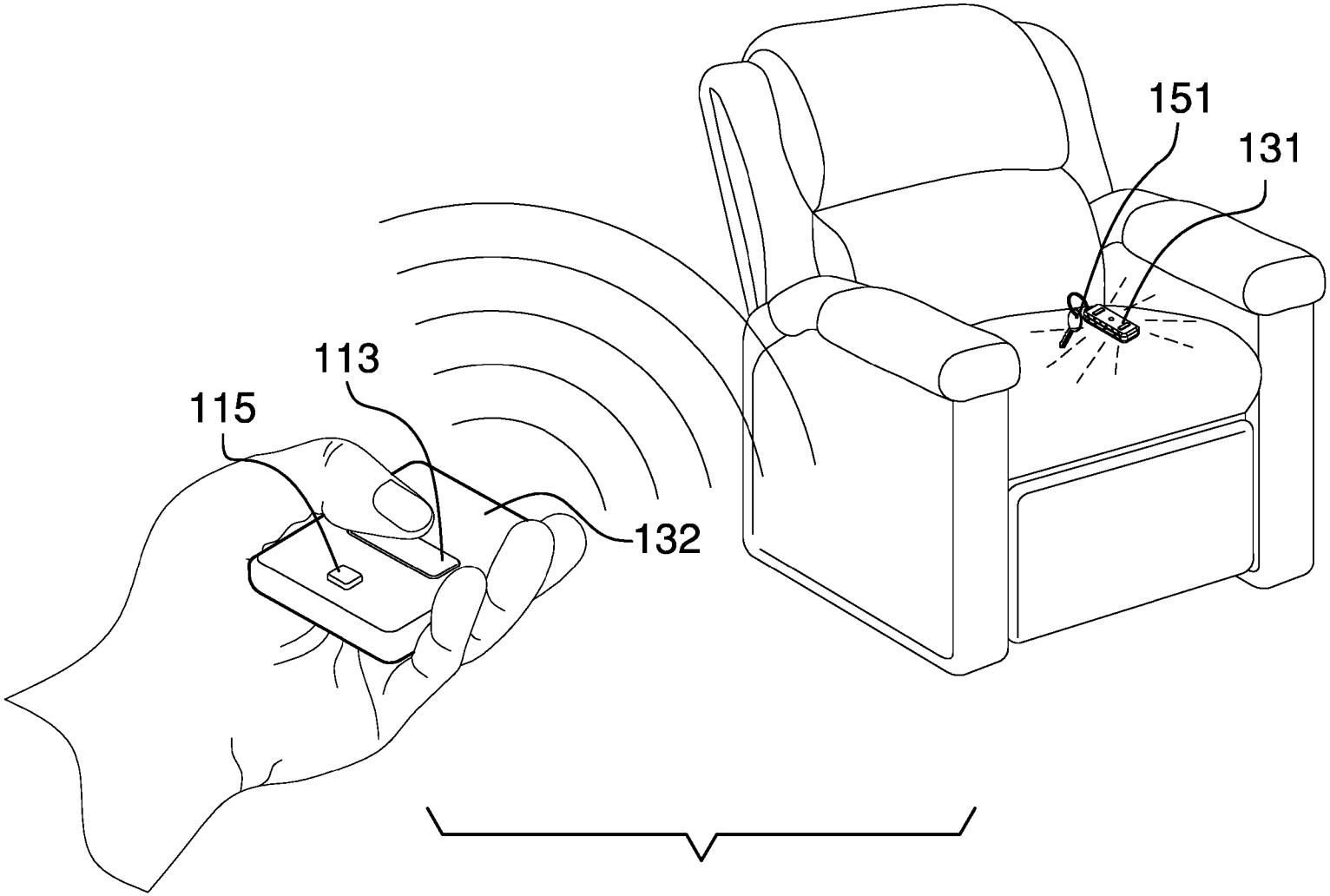
FIG. 5 is an in use view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 6.

The misplaced key-locating system 100 (hereinafter invention) comprises a plurality of devices 101. The invention 100 is a bidirectional location system that is adapted for use with a plurality of domestic articles 151. Each of the plurality of devices 101 is attached to a domestic article selected from the plurality of domestic articles 151. Each of the plurality of domestic devices is bidirectional in the sense that each device selected from the plurality of devices 101 wirelessly communicates with the each of the devices remaining in the plurality of selected devices. This bidirectional capability allows any first selected device selected from the plurality of devices 101 to initiate an announcement from any second selected device selected from the remaining devices in the plurality of devices 101. The announcement comprises audio and visual signals indicating the location of the selected second selected device.

Each of the plurality of devices 101 further comprises a housing 111, a radio frequency remote control relay 112, a switch 113, a buzzer 114, a lamp 115, a timing circuit 116, and a battery 117.

The housing 111 is a casing that is used to enclose the remaining components of each of the plurality of devices 101. The housing 111 is constructed such that the switch 113, the lamp 115 and the buzzer 114 are accessible from the exterior of the housing 111. The housing 111 of each device selected from the plurality of devices 101 is designed specifically for the purpose of being attached to a specific domestic article selected from the plurality of domestic articles 151. This can be made clearer with an example: a housing 111 intended for use with a set of keys may have physical characteristics (including but not limited to shape, size and the locations of the switch 113, the lamp 115 and the buzzer 114) that are different from the physical characteristics of the housing 111 of a different device selected from the plurality of devices 101 that is intended for use with a purse or a remote control.

The housing 111 is the only significant difference between devices selected from the plurality of devices 101. The balance of the invention 100 as described in this disclosure is essentially identical across each device selected from the plurality of devices 101. Any differences will involve the operational settings of the device such as the selection of radio frequencies used by a device selected from the plurality of devices 101 or the assignment of identification codes to a device selected from the plurality of devices 101.

Figure 6:
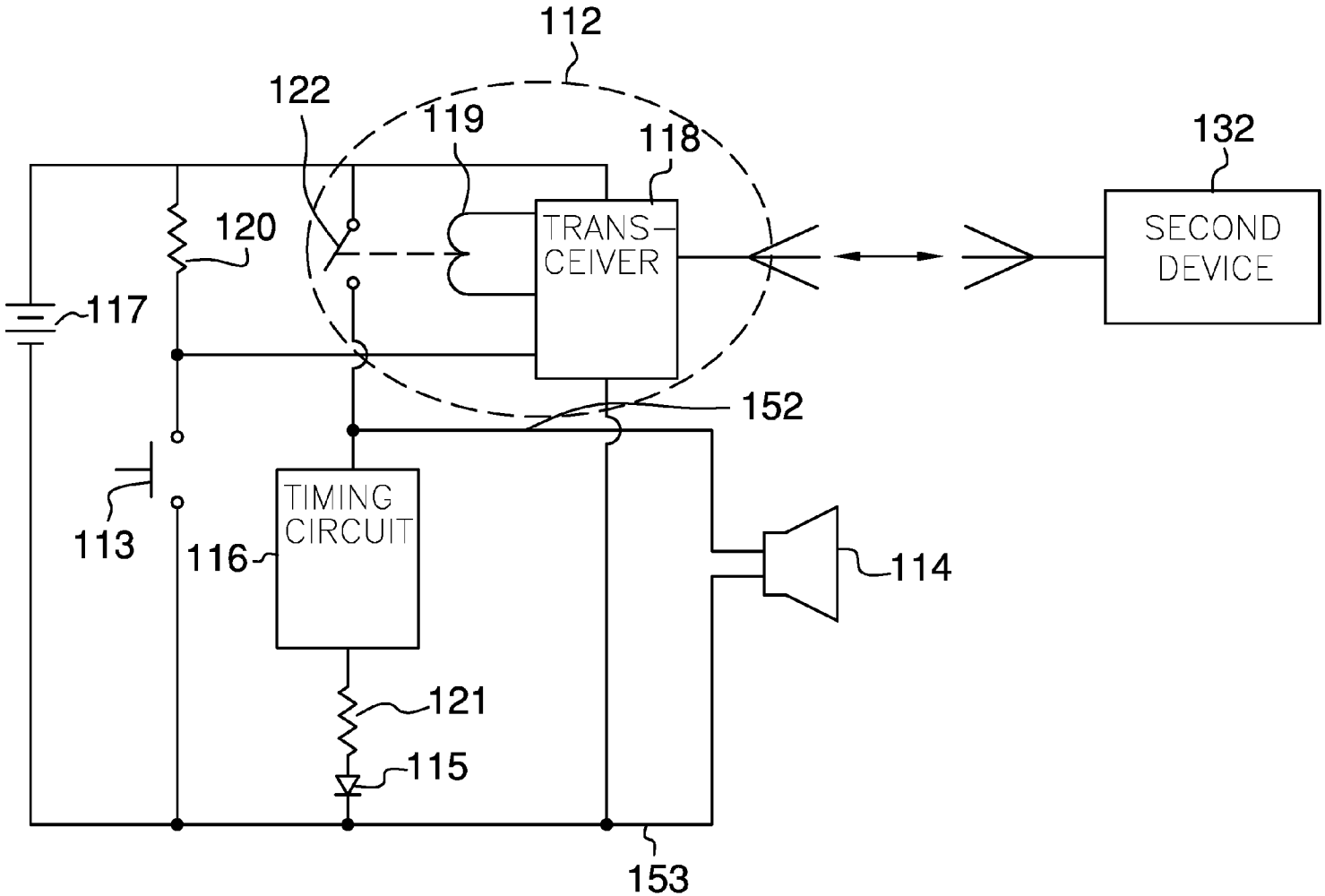
FIG. 6 is a schematic view of an embodiment of the disclosure.

The radio frequency remote control relay 112 is a circuit that is designed to receive radio signal of a predetermined frequency and upon receiving the radio signal to activate a relay 119. The radio frequency remote control relay 112 is further designed to transmit a radio signal of a predetermined frequency that will activate the radio frequency remote control relay 112 of a second selected device selected from the plurality of devices 101. As shown in FIG. 6, the radio frequency remote control relay 112 further comprises a transceiver 118 and a relay 119. The transceiver 118 transmits and receives the radio frequency signals indication that the relay 119 should be operated. The relay 119 is a device that opens and closes the electrical circuit. Specifically, as shown in FIG. 6, the relay 119 is placed in series between the battery 117 and the buzzer 114, the lamp 115, and the timing circuit 116 such that when the transceiver 118 initiates the closing of the relay switch 122 of the relay 119, the battery 117 powers the buzzer 114, the lamp 115, and the timing circuit 116. The buzzer 114, the lamp 115, and the timing circuit 116 are discussed elsewhere in this disclosure. Methods to design and assemble radio frequency remote control relays 112 are well known and documented in the art. The components necessary to assemble the radio frequency remote control relay 112 described in this disclosure can be drawn from one or more commercially available remote control kits.

The battery 117 is a commercially available battery that is used to power the device selected from the plurality of devices 101 that the battery 117 is associated with.

Radio frequency signals from the transceiver 118 from a first selected device selected from the plurality of devices 101 to the transceiver 118 of a second selected device selected from the plurality of devices 101 are initiated in the first selected device selected from the plurality of devices 101 using the switch 113 and a pull up resistor 120. As shown in FIG. 6, the battery 117, the pull up resistor 120 and the switch 113 are assembled as a series circuit wherein the pull up resistor 120 is placed between the positive terminal of the battery 117 and the switch 113. A lead from between the switch 113 and the pull up resistor 120 is connected to the transceiver 118 such that when the switch 113 is open a voltage drop is measured across the switch 113. When the switch 113 is closed, the voltage drop across the switch 113 is eliminated and the transceiver 118 uses this as a signal to transmit the radio frequency signals from the transceiver 118 from the first selected device selected from the plurality of devices 101 to the transceiver 118 of the second selected device selected from the plurality of devices 101. To reverse the logic of the voltage signal, one can change the positions of the pull up resistor 120 and the switch 113 in the circuit while continuing to keep the lead to the transceiver 118 connected between the switch 113 and the pull up resistor 120. The purpose of the pull up resistor 120 is to position the voltage drop in the circuit and to limit the current flowing through the switch 113.

The lamp 115 is a commercially available light that is used to provide a visual signal during the announcement of a device selected from the plurality of devices 101. The buzzer 114 is a commercially available noise generating device that is used to provide an audible signal during the announcement of a device selected from the plurality of devices 101.

The timing circuit 116 is an electrical circuit that is designed to generate and then discontinue a voltage at a regular interval. The timing circuit 116 is used to power the lamp 115 such that the lamp 115 will flash during the announcement of a device selected from the plurality of devices 101. Methods to design and implement timing circuits 116 are well known and documented in the electrical arts.

The timing circuit 116, the lamp 115 and a limit resistor 121 are connected in series. The relay switch 122 portion of the relay 119 is connected in series between the positive terminal of the battery 117 and the circuit consisting of the timing circuit 116, the lamp 115 and a limit resistor 121. As shown in FIG. 6, the limit resistor 121 is connected to the battery 117 to complete the circuit described in this paragraph. When the transceiver 118 initiates the closure of the relay switch 122 portion of the relay 119, power flows through the circuit described in this paragraph which initiates announcement of the device by flashing the lamp 115. The purpose of the limit resistor 121 is to limit current flow through the lamp 115.

As shown in FIG. 6, the first lead 152 of the buzzer 114 is connected to the circuit described in the previous paragraph between the relay switch 122 portion of the relay 119 and the timing circuit 116. The second lead 153 of the buzzer 114 is attached to the negative lead of the battery 117. When the circuit described in the above paragraph is initiated, the buzzer 114 will be powered and will generate an audible signal to announce the device.

In the first potential embodiment of the disclosure, the plurality of devices 101 further comprises a first device 131 and a second device 132. Each radio frequency remote control relay 112 is assembled from two 433 MHz fixed code 4 channel wireless radio controller that are readily and commercially available. The two 433 MHz fixed code 4 channel wireless radio controller are modified such that the two 433 MHz fixed code 4 channel wireless radio controllers will fit within the housing 111 of the first device 131 and the housing 111 of the second device 132. The switch 113 is a normally open momentary switch. The lamp 115 is an LED.

To use the invention 100, the switch 113 of the first device 131 is closed in order to activate the device. The switch 113 signals the transceiver 118 to initiate a radio frequency signal to the second device 132. The transceiver 118 of the second device 132 receives the radio frequency signal from the first device 131 and initiates the relay 119 contained within the second device 132 to initiate the announcement by the flashing of the lamp 115 and the sounding of the buzzer 114.

In order to extend the number of devices contained with the plurality of devices 101, one additional switch 113 needs to be added to the housing 111 and one additional radio frequency remote control relay 112 has to be added into the housing 111 of each existing device incorporated into the plurality of devices 101. In addition, one additional device needs to be added to the plurality of devices 101. Each individual device contained with the plurality of devices 101 can be differentiated from the other devices contained within the plurality of devices 101 through the use of a coding scheme or the use of different radio frequencies. The use of coded multi-channel kits in the first potential embodiment of the disclosure simplifies the expansion of the invention 100 in this way. For example, if the first potential embodiment of the disclosure was extended to become a second potential embodiment of the disclosure by extending the plurality of devices 101 to a third device then it would be preferred that a third 433 MHz fixed code 4 channel wireless radio controller be purchased for this purpose.

The following definitions were used in this disclosure:

Battery: As used in this disclosure, a battery is a container consisting of one or more cells, in which chemical energy is converted into electricity and used as a source of power.

Buzzer: As used in this disclosure, a buzzer is two lead electrical device that generates an audible sound when voltage is applied to the two leads.

Domestic Article: As used in this disclosure, a domestic article is an item or object: 1) that is commonly found within a household; or, 2) that is commonly carried by a person. Examples of domestic articles include, but are not limited to, keys, personal data devices, glasses, remote controls, or personal storage items such as purses, briefcases, wallets, or cases.

Housing: As used in this disclosure, a housing is a rigid casing that: encloses and protects one or more devices.

LED: As used in this disclosure, an LED is an acronym for a light emitting diode. A light emitting diode is a 2 lead semiconductor that is also a light source.

Light: As used in this disclosure, a light is an electrical device that generates visible light to illuminate objects so they can be seen.

Personal Data Device: As used in this disclosure, a personal data device is a handheld device that is used for managing personal information and communication. Examples of personal data device include, but are not limited to, cellular phones, tablets and smart phones.

Relay: As used in this disclosure, a relay is an automatic electromagnetic or electromechanical device that reacts to changes in voltage or current by opening or closing a switch in an electric circuit.

Remote Control: As used in this disclosure, remote control means the establishment of control of a device from a distance. Remote control is generally accomplished through the use of an electrical device that generates electrically based control signals that are transmitted via radio frequencies or other means to the device.

Timing Circuit: As used in this disclosure, a timing circuit refers to an electrical network of interconnected electrical elements, potentially including but not limited to, resistors, capacitors, diodes, transistors, and integrated circuit devices. The purpose of the timing circuit is to generate a continuous electrical control signal and then, after a predetermined amount of time, to discontinue or remove the said electrical control signal. In common usage, a timing circuit is also referred to as timing circuitry.

Transceiver: As used in this disclosure, a transceiver is a device that is used to transmit and receive radio signals.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A locating system comprising:

a plurality of devices;

wherein the locating system is a bidirectional location system;

wherein the locating system is adapted for use with a plurality of domestic articles;

wherein each of the plurality of devices is attached to a domestic article selected from the plurality of domestic articles;

wherein each device selected from the plurality of devices wirelessly communicates with the each of the devices remaining in the plurality of selected devices;

wherein any first selected device selected from the plurality of devices can initiate an announcement from any second selected device selected from the remaining devices in the plurality of devices;

wherein each of the plurality of devices further comprises a housing, a radio frequency remote control relay, a switch, a buzzer, and a lamp;

wherein the radio frequency remote control relay further comprises a relay;

wherein the radio frequency remote control relay comprises an electric circuit that is designed to receive radio signal of a predetermined frequency and upon receiving the radio signal to activate a relay;

wherein the radio frequency remote control relay further comprises an electric circuit that transmits a radio signal of a predetermined frequency;

wherein the relay is placed in series with a first sub-circuit comprising the buzzer and the lamp;

wherein the switch initiates the transmission of radio signal of a predetermined frequency;

wherein each of the plurality of devices further comprises a timing circuit;

wherein the timing circuit is an electrical circuit that is designed to generate and then discontinue a voltage at a regular interval;

wherein the timing circuit and the lamp are connected in series;

wherein the switch is a normally open momentary switch;

wherein the lamp is an LED;

wherein each of the plurality of devices further comprises a pull up resistor and a limit resistor.

2. The locating system according to claim 1 wherein the announcement further comprises audio and visual signals.

3. The locating system according to claim 1 wherein the relay is placed in series between a battery and a first sub-circuit comprising the buzzer, the lamp, and the timing circuit.

4. The locating system according to claim 3 wherein the relay is connected in series between the battery and the first sub-circuit;

wherein the buzzer further comprises a first lead and a second lead;

wherein the first lead is connected between the relay and the timing circuit.

5. The locating system according to claim 4 wherein the plurality of devices further comprises a first device and a second device.

6. The locating system according to claim 5 wherein the plurality of devices further comprises a one or more additional devices that operate in the same manner as the first device and the second device.

* * * * *